US010438754B2

(12) United States Patent
Fasano

(10) Patent No.: US 10,438,754 B2
(45) Date of Patent: Oct. 8, 2019

(54) LOW PROFILE CIRCUIT BREAKER WITH SELF CLEANING CONTACTS

(71) Applicant: Carling Technologies, Inc., Plainville, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 120 days.

(21) Appl. No.: 15/813,705

(22) Filed: Nov. 15, 2017

(65) Prior Publication Data

US 2019/0148086 A1 May 16, 2019

(51) Int. Cl.

| | |
|---|---|
| ***H01H 75/00*** | (2006.01) |
| ***H01H 1/58*** | (2006.01) |
| ***H01H 71/02*** | (2006.01) |
| ***H01H 71/50*** | (2006.01) |
| ***H01H 71/48*** | (2006.01) |
| ***H01H 9/16*** | (2006.01) |
| ***H01H 1/18*** | (2006.01) |

(Continued)

(52) U.S. Cl.

CPC ..... *H01H 1/5833* (2013.01); *H01H 1/18* (2013.01); *H01H 9/16* (2013.01); *H01H 71/0264* (2013.01); *H01H 71/48* (2013.01); *H01H 71/501* (2013.01); *H01H 73/04* (2013.01); *H01H 1/24* (2013.01); *H01H 3/46* (2013.01); *H01H 71/2463* (2013.01); *H01H 73/24* (2013.01); *H01H 73/30* (2013.01); *H01H 2071/042* (2013.01); *H01H 2071/7481* (2013.01)

(58) Field of Classification Search

CPC ..... H02H 1/0015; H02H 3/33; H02H 3/334; G01R 31/2801

USPC ..... 335/6

See application file for complete search history.

(56) References Cited

U.S. PATENT DOCUMENTS 3,134,871 A * 5/1964 Norden ..... H01H 9/40 218/17

3,286,067 A * 11/1966 Menickella ..... H01H 73/04 200/244

(Continued)

FOREIGN PATENT DOCUMENTS

| | | |
|---|---|---|
| GB | 855730 | 12/1960 |
| GB | 2137418 | 10/1984 |

*Primary Examiner* — Shawki S Ismail
*Assistant Examiner* — Lisa N Homza
(74) *Attorney, Agent, or Firm* — Forge IP, PLLC

(57) ABSTRACT

A circuit interrupter includes a stationary contact and a moveable contact arm assembly having a moveable contact positioned thereon, the moveable contact configured to be moveable into and out of physical contact with the stationary contact. The circuit interrupter also includes an overcurrent tripping device coupled to the moveable contact arm assembly via a linkage assembly and configured to move the moveable contact out of physical contact with the stationary contact upon detection of an overcurrent situation. The moveable contact arm assembly is connected to the linkage assembly via at least two pivots positioned on the contact arm assembly, so as to cause a relative sliding action between the moveable and stationary contacts as the moveable and stationary contacts are moved into or out of contact with each other such that a wiping action is created in order to clean the moveable and stationary contacts.

19 Claims, 3 Drawing Sheets

(51) Int. Cl.

| | |
|---|---|
| ***H01H 73/04*** | (2006.01) |
| *H01H 71/74* | (2006.01) |
| *H01H 71/04* | (2006.01) |
| *H01H 1/24* | (2006.01) |
| *H01H 3/46* | (2006.01) |
| *H01H 71/24* | (2006.01) |
| *H01H 73/24* | (2006.01) |
| *H01H 73/30* | (2006.01) |

(56) References Cited

U.S. PATENT DOCUMENTS 4,760,226 A * 7/1988 Fasano ..... H01H 71/025 200/303
4,900,275 A * 2/1990 Fasano ..... H02B 1/052 439/716
5,053,736 A * 10/1991 Fasano ..... H01H 73/18 335/177
5,486,660 A * 1/1996 Fasano ..... H01H 71/1054 200/303
5,744,772 A * 4/1998 Fasano ..... H01H 9/46 218/148
9,966,209 B1 * 5/2018 Fasano ..... H01H 33/20
10,236,145 B1 * 3/2019 Fasano ..... G01R 19/16571
2004/0145846 A1 * 7/2004 Fasano ..... H01H 71/123 361/102
2008/0247100 A1 * 10/2008 Fasano ..... H01H 83/02 361/45
2011/0141633 A1 * 6/2011 Fasano ..... H01H 83/02 361/42
2012/0168295 A1 * 7/2012 Lin ..... H01H 73/52 200/560
2012/0262255 A1 * 10/2012 Fasano ..... H01H 71/2409 335/7
2013/0180956 A1 * 7/2013 Fasano ..... H01H 33/20 218/148
2014/0251959 A1 * 9/2014 Fasano ..... H01H 9/30 218/155
2016/0379789 A1 * 12/2016 Fasano ..... H01H 71/40 335/18
2017/0032905 A1 * 2/2017 Fasano ..... H01H 9/26
2017/0047185 A1 * 2/2017 Fasano ..... H01H 71/08

* cited by examiner

LOW PROFILE CIRCUIT BREAKER WITH SELF CLEANING CONTACTS

FIELD OF THE INVENTION

The invention relates to the field of circuit breakers. More specifically, the invention relates to a circuit breaker having an improved design that allows for a more compact circuit breaker and also for self cleaning action of the contacts thereof.

BACKGROUND OF THE INVENTION

Circuit interrupters are electrical components that can be used to break an electrical circuit, interrupting the current flow. A basic example of a circuit interrupter is a switch, which generally consists of two electrical contacts in one of two states; either closed, meaning that the contacts are touching and electricity can flow between them, or open, meaning that the contacts are separated, and no electricity can flow between them. A switch may be directly manipulated by a human to provide a control signal to a system, such as a computer keyboard button, or to control power flow in a circuit, such as a light switch.

Another example of a circuit interrupter is a circuit breaker. A circuit breaker may be used, for example, in an electrical panel to limit the electrical current being sent through the electrical wiring. A circuit breaker is designed to protect an electrical circuit from damage caused by an overload or a short circuit. If a fault condition such as a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a terminal connected to a power supply, such as a power line from a power company, and another terminal connected to the circuit that the breaker is intended to protect. Conventionally, these terminals are referred to as the "line" and "load" respectively. The line may sometimes be referred to as the input into the circuit breaker. The load, sometimes referred to as the output, feeds out of the circuit breaker and connects to the electrical components being fed from the circuit breaker.

A circuit breaker may be used to protect an individual device, or a number of devices. For example, an individual protected device, such as a single air conditioner, may be directly connected to a circuit breaker. A circuit breaker may also be used to protect multiple devices by connecting to multiple components through a power wire which terminates at electrical outlets, for example.

A circuit breaker can be used as a replacement for a fuse. Unlike a fuse however, which operates once and then must be replaced, a circuit breaker can be reset (either manually or automatically) to resume normal operation. Fuses perform much the same circuit protection role as circuit breakers. However, circuit breakers may be safer to use in some circumstances than fuses, and may be easier to fix.

For example, in a situation where a fuse blows, interrupting power to a section of a building for example, it may not be apparent which fuse controls the interrupted circuit. In this case, all of the fuses in the electrical panel would need to be inspected to determine which fuse appears burned or spent. This fuse would then need to be removed from the fuse box, and a new fuse would need to be installed.

In this respect, circuit breakers can be much simpler to use than fuses. In a situation where a circuit breaker trips, interrupting power to a section of a building for example, it may be easily apparent which circuit breaker controls the interrupted circuit by looking at the electrical panel and noting which breaker has tripped to the "off" position. This breaker can then be simply flipped to the "on" position and power will resume again.

In general, a typical circuit interrupter has two contacts located inside of a housing. The first contact is stationary, and may be connected to either the line or the load. The second contact is movable with respect to the first contact, such that when the circuit breaker is in the "off" or tripped position, a gap exists between the first and second contact.

A problem with circuit interrupters that operate by separating contacts arises because the energized contacts separate when the circuit breaker is tripped, causing a gap to widen between the contacts while the movable contact moves from the closed position to the open position.

As the contacts begin to separate from the closed position, or approach complete closure from an open position, a very small gap exists between the contacts for a brief time while the contacts are closed or opened. An electric arc may be generated across this gap if the voltage between the contacts is high enough. The creation of an arc during switching or tripping the circuit interrupter can result in undesirable side effects which can negatively affect the operation of the circuit interrupter, and which can create a safety hazard.

These effects can have consequences for the operation of the circuit interrupter. One possible consequence is that the arc energy may damage the contacts, causing deposits on the contacts, which may interfere with the electrical communication between the contacts. These deposits only exacerbate the potential corrosion that may occur over time and may cause interference with electrical communication between the contacts, even without arcing.

Another potential issue with known circuit breaker designs is that they sometimes require a relatively large profile in the device or component in which the circuit breaker is to be installed. As components get smaller and smaller, tenths of an inch become more important and, therefore, any shrinking of the profile of a circuit breaker is desired.

It is therefore desired to provide an alternative construction for a circuit interrupter that reduces the potential for corrosion and/or deposits causing interference with the electrical communication between the contacts, while also providing a design that is low in profile.

SUMMARY OF THE INVENTION

To this end, a circuit interrupter is provided having a housing within which components of the circuit interrupter are disposed, the circuit interrupter including a line terminal connectable to a source of electrical power, a load terminal connectable to a load, a stationary contact positioned within said housing and a moveable contact arm assembly having a moveable contact positioned thereon, the moveable contact configured to be moveable into and out of physical contact with the stationary contact by movement of the moveable contact arm assembly so as to place the line terminal and the load terminal into and out of electrical communication. The circuit interrupter also includes an overcurrent tripping device coupled to the moveable contact arm assembly via a linkage assembly and configured to move the moveable contact out of physical contact with the stationary contact upon detection of an overcurrent situation.

The moveable contact arm assembly is connected to the linkage assembly via at least two pivots positioned on the contact arm assembly, so as to cause a relative sliding action between the moveable contact and the stationary contact as the moveable contact and the stationary contact are moved into or out of contact with each other such that a wiping action is created in order to clean the moveable and stationary contacts.

In some embodiments, the moveable contact arm assembly comprises a contact arm carriage and a contact arm member, the contact arm member slideable within the contact arm carriage, and wherein the at least two pivots positioned on the contact arm assembly are positioned on the contact arm carriage.

In some of these embodiments, the contact arm carriage has at least one slot formed therein, and wherein the contact arm member comprises at least one pin projecting from a surface thereof, the at least one pin cooperating with and slideable within the at least one slot.

In some embodiments, the at least one pin slides within the at least one slot as the moveable contact and the stationary contact are moved into and out of contact with each other.

In some embodiments, a biasing member cooperates with the contact arm carriage and the contact arm member, the biasing member biasing the contact arm carriage and the contact arm member with respect to each other such that the at least one pin is biased toward a first end of the at least one slot.

In some of these embodiments, the at least one pin is moveable against the bias toward a second end of the at least one slot as the moveable contact and the stationary contact are moved into and out of contact with each other.

In some embodiments, the biasing member is a spring positioned between the contact arm carriage and the contact arm member.

In certain of these embodiments, the spring is a leaf spring.

In some embodiments, the circuit interrupter includes a resetting mechanism adapted to reset the circuit interrupter and move the moveable contact into physical contact with the stationary contact by movement of the moveable contact arm assembly, the resetting mechanism being connected to the linkage assembly via at least two pivots positioned on the resetting mechanism.

In some of these embodiments, the resetting mechanism comprises a handle having a portion thereof extending from the housing adapted to be actuated by a user.

In other embodiments, the resetting mechanism comprises a push button mechanism having a portion thereof extending from the housing adapted to be actuated by a user.

In another respect, the present invention provides a circuit interrupter having a housing within which components of the circuit interrupter are disposed, the circuit interrupter comprising a line terminal connectable to a source of electrical power, a load terminal connectable to a load, a stationary contact positioned within said housing and a moveable contact arm assembly having a moveable contact positioned thereon, the moveable contact configured to be moveable into and out of physical contact with the stationary contact by movement of the moveable contact arm assembly so as to place the line terminal and the load terminal into and out of electrical communication. The moveable contact arm assembly comprises a contact arm carriage and a contact arm member, the contact arm member slideable within the contact arm carriage, and wherein the at least two pivots positioned on the contact arm assembly are positioned on the contact arm carriage. An overcurrent tripping device is coupled to the moveable contact arm assembly via a linkage assembly and is configured to move the moveable contact out of physical contact with the stationary contact upon detection of an overcurrent situation. The moveable contact arm assembly is connected to the linkage assembly via at least two pivots positioned on the contact arm assembly, so as to cause a relative sliding action between the moveable contact and the stationary contact as the moveable contact and the stationary contact are moved into or out of contact with each other such that a wiping action is created in order to clean the moveable and stationary contacts. The circuit interrupter also includes a resetting mechanism adapted to reset the circuit interrupter and move the moveable contact into physical contact with the stationary contact by movement of the moveable contact arm assembly, the resetting mechanism being connected to the linkage assembly via at least two pivots positioned on the resetting mechanism.

Other objects of the invention and its particular features and advantages will become more apparent from consideration of the following drawings and accompanying detailed description.

DETAILED DESCRIPTION OF THE INVENTION

Figure 1:
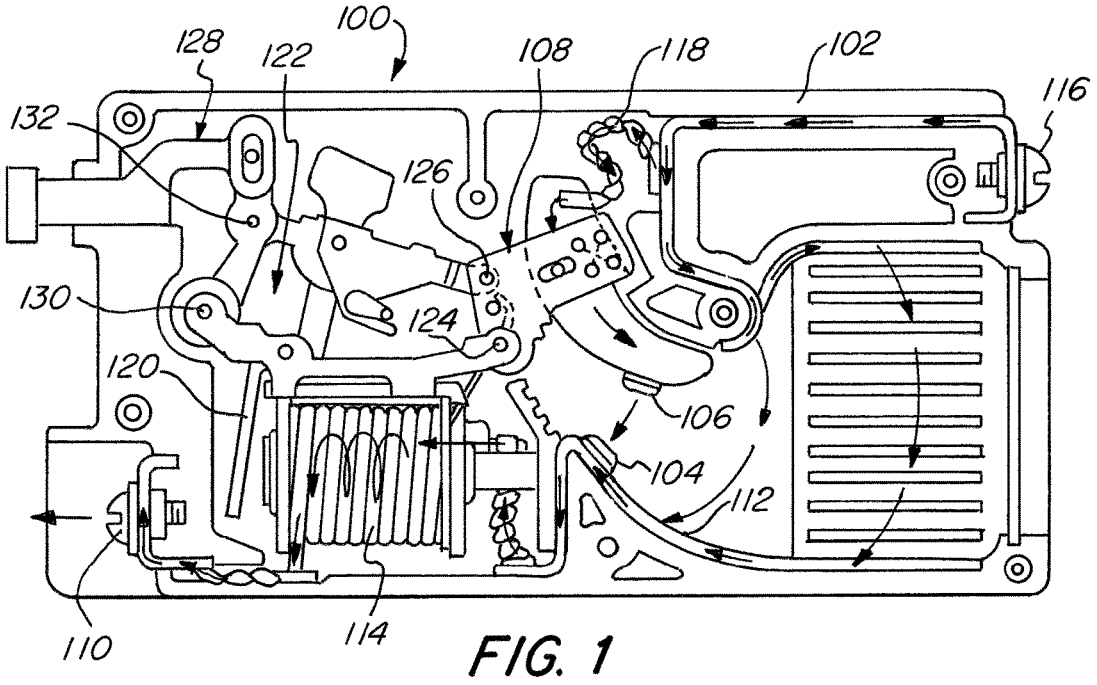
FIG. 1 is an illustration of one aspect of the circuit interrupter according to the invention.

Referring now to the drawings, wherein like reference numerals designate corresponding structure throughout the views.

FIG. 1 illustrates components of an example circuit interrupter 100 having an improved design that allows for a more compact circuit breaker and also for self-cleaning action of the contacts thereof according to aspects of the invention.

Figure 2:
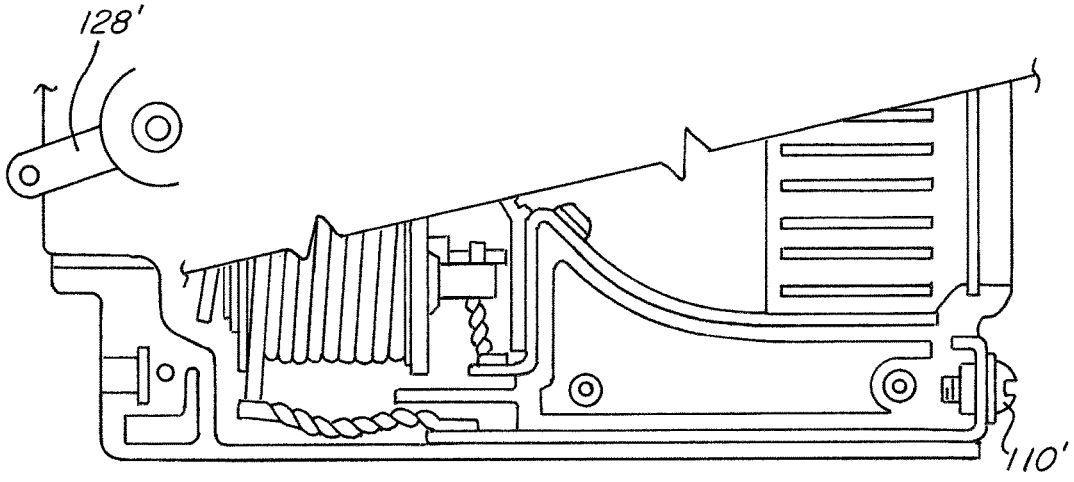
FIG. 2 is a partial view similar to FIG. 1, showing optional alterations to the circuit interrupter shown therein.
Figure 3:
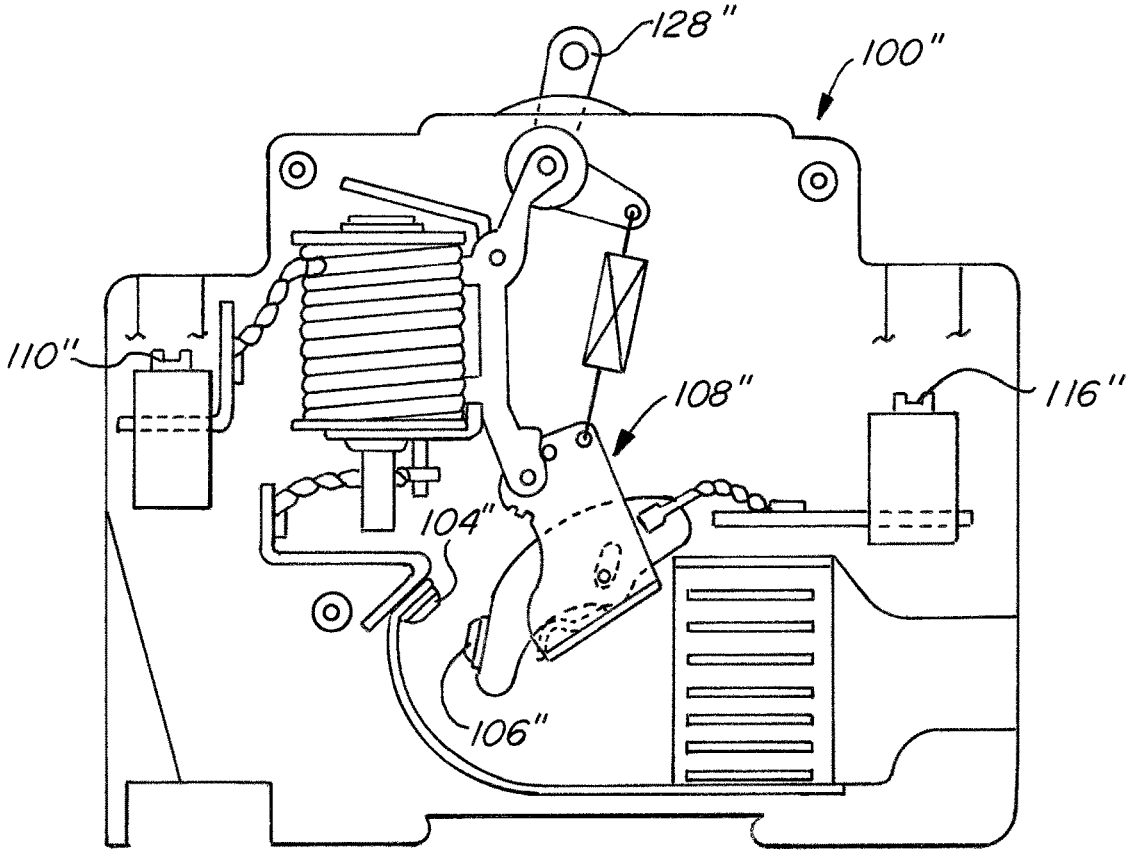
FIG. 3 is another partial view similar to FIG. 1, showing further optional alterations to the circuit interrupter shown therein.

Circuit interrupter 100 is provided with a housing 102 that contains the working elements of the device. The circuit interrupter is further provided with a set of contacts including a stationary contact 104 and movable contact 106. The moveable contact 106 is positioned on a moveable contact arm assembly 108, and the moveable contact 106 is configured to move between an open and closed position relative to the stationary contact 104. Reference to FIGS. 1-4A show the contacts 104, 106 in the open position where no electrical current flows therebetween; whereas FIG. 4B shows the contacts 104, 106 in a closed position.

Also shown in FIG. 1 is a "line" terminal 110, which is designed to be connected to a source of electrical power, such as a bus bar in a panel board or load center. Stationary contact 104 is mounted onto a first conductive element 112, which in turn is electrically connected to line terminal 110 through an overcurrent tripping device 114.

Moveable contact 106 mounted on moveable contact arm assembly 108 is in electrical communication with a "load" terminal 116 via a conductive connector 118.

In operation, electrical power is input into circuit interrupter 100 via line terminal 110, which passes through overcurrent tripping device 114. If the electrical current exceeds a threshold level, overcurrent tripping device 114 will function to "trip" the circuit interrupter 100 by opening the circuit (opening the contacts relative to each other by means of a trip mechanism 120 and linkage assembly 122) such that the flow of electrical current through the contacts 104,106 ceases. In the event that the electrical current does not exceed the threshold level set by overcurrent tripping device 114, the electrical power is allowed to pass through load terminal 116, which in turn, provides electrical power to the connected circuit and/or equipment.

The moveable contact arm assembly 108 is connected to the linkage assembly 122 via at least two pivots 124,126 positioned on the contact arm assembly 108. The pivots are arranged so as to cause a relative sliding action between the moveable contact 106 and the stationary contact 104 as the moveable contact 106 and the stationary contact 104 are moved into or out of contact with each other such that a wiping action is created in order to clean the moveable and stationary contacts 104,106.

The circuit interrupter 110 also includes a resetting mechanism 128 adapted to reset the circuit interrupter 100 and move the moveable contact 106 into physical contact with the stationary contact 104 by movement of the moveable contact arm assembly 108. The resetting mechanism 128 is connected to the linkage assembly 122 via at least two pivots 130,132 positioned on the resetting mechanism 128, and has a portion extending from the housing adapted to be actuated by a user in order to reset the circuit interrupter 100 when it has been tripped. The resetting mechanism 128 may also be used to manually open the contacts 104,106, as is known in the art.

In FIG. 1, the resetting mechanism 128 takes the form of a push-button that may be pressed by a user to reset a tripped circuit interrupter. In FIGS. 2 and 3, the resetting mechanism 128', 128" takes the form of a handle that may be pivoted by a user to reset a tripped circuit interrupter.

With respect to FIG. 2, as compared to FIG. 1, another difference is that the line terminal 110' has been repositioned to be on the right side (with reference to the Figures) instead of on the left, as is the line terminal 110 shown in FIG. 1. Other similar changes may also be made without departing from the inventive aspects described herein.

With respect to FIG. 3, as compared to FIG. 1, both the line terminal 110" and the load terminal 116" have been repositioned to face upward (with reference to the Figures), and the handle 128" has also repositioned to extend from the top surface of the housing 102". The position of the contacts 104",106" and the orientation of various other components, including the moveable contact arm assembly 108" have also been changed to accommodate the change in position of the terminals 110",116" and the handle 128", although the circuit interrupter 100" still functions in the same way as does the circuit interrupter 100 shown in FIG. 1 in pertinent respects. Circuit interrupter 100" of FIG. 3 is configured specifically to accommodate DIN rail mounting.

Figure 4A:
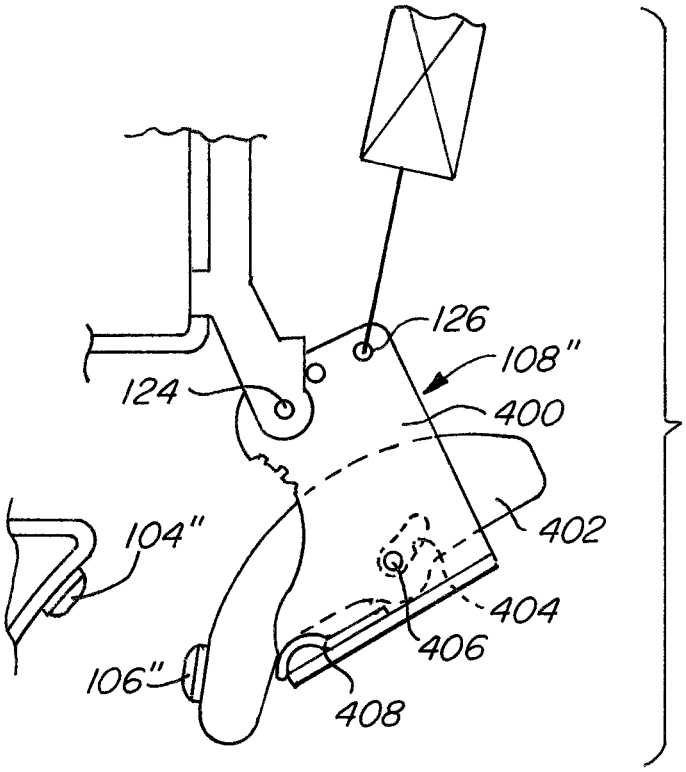
FIGS. 4A and 4B are illustrations of a portion of the circuit interrupter of FIGS. 1-3 showing the contacts in the open position and the closed position, respectively.
Figure 4B:
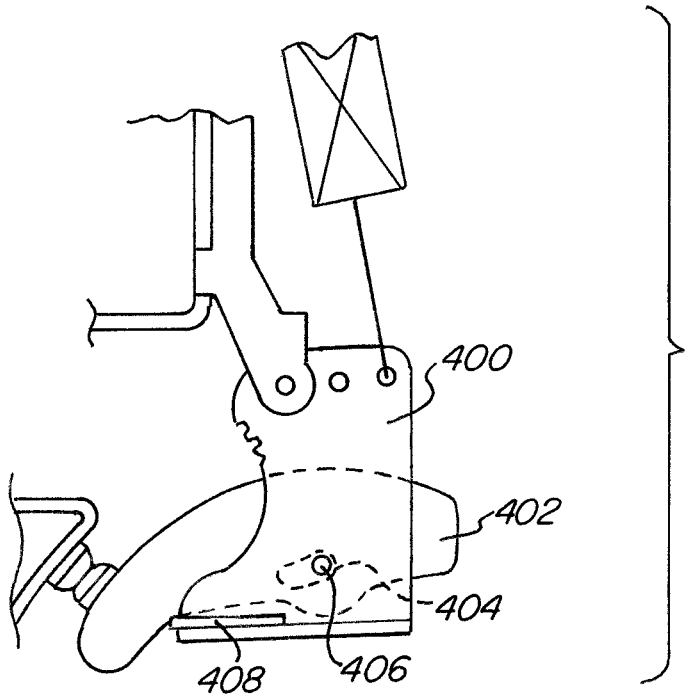

Turning now specifically to FIGS. 4A and 4B, the moveable contact arm assembly 108, 108" includes a contact arm carriage 400 and a contact arm member 402, the contact arm member 402 slideable within the contact arm carriage 400. As can be seen, the aforementioned pivots 124,126 positioned on the contact arm assembly 108, 108" are more specifically positioned on the contact arm carriage 400. It is worth noting that although FIGS. 4A and 4B specifically show the orientation of components shown in FIG. 3, the configuration of the contact arm assembly 108, 108" is substantially the same in all of FIGS. 1-3, as described below.

The contact arm carriage 400 has a slot 404 formed therein, the contact arm member 402 includes a pin 406 projecting from a surface thereof, the pin 406 cooperating with and slideable within the slot 404. This allows for a retained sliding and pivoting arrangement between the contact arm member 402 within the contact arm carriage 400, as will be understood by those skilled in the art.

More specifically, the pin 406 slides within the slot 404 as the moveable contact 106" and the stationary contact 104" are moved into and out of contact with each other, which helps contribute to the relative "wiping" action therebetween.

A biasing member 408 cooperates with the contact arm carriage 400 and the contact arm member 402, the biasing member 408 biasing the contact arm carriage 400 and the contact arm member 402 with respect to each other such that the pin 406 is biased toward a first end of the slot 404 (as shown in FIG. 4A). The pin 406 is moveable against the bias toward a second end of the slot 404 as the moveable contact 106" and the stationary contact 104" are moved into and out of contact with each other (as shown in FIG. 4B).

The biasing member 408 may take the form of a spring positioned between the contact arm carriage 400 and the contact arm member 402, although it may take other forms as well. Even more specifically, in the embodiment shown in the Figures, the biasing member 408 takes the form of a leaf spring.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter having a housing within which components of the circuit interrupter are disposed, the circuit interrupter comprising:

a line terminal connectable to a source of electrical power;

a load terminal connectable to a load;

a stationary contact positioned within said housing;

a moveable contact arm assembly having a moveable contact positioned thereon, the moveable contact arm assembly comprising a contact arm carriage and a contact arm member, the contact arm member slideable within the contact arm carriage, the moveable contact configured to be moveable into and out of physical contact with the stationary contact by movement of the moveable contact arm assembly so as to place the line terminal and the load terminal into and out of electrical communication; and an overcurrent tripping device coupled to the moveable contact arm assembly via a linkage assembly and configured to move the moveable contact out of physical contact with the stationary contact upon detection of an overcurrent situation;

wherein the moveable contact arm assembly is connected to the linkage assembly via at least two pivots positioned on the contact arm carriage of the contact arm assembly, so as to cause a relative sliding action between the moveable contact and the stationary contact as the moveable contact and the stationary contact are moved into or out of contact with each other such that a wiping action is created in order to clean the moveable and stationary contacts.

2. The circuit interrupter of claim 1, wherein the contact arm carriage has at least one slot formed therein, and wherein the contact arm member comprises at least one pin projecting from a surface thereof, the at least one pin cooperating with and slideable within the at least one slot.

3. The circuit interrupter of claim 2, wherein the at least one pin slides within the at least one slot as the moveable contact and the stationary contact are moved into and out of contact with each other.

4. The circuit interrupter of claim 2, further comprising a biasing member cooperating with the contact arm carriage and the contact arm member, the biasing member biasing the contact arm carriage and the contact arm member with respect to each other such that the at least one pin is biased toward a first end of the at least one slot.

5. The circuit interrupter of claim 4, wherein the at least one pin is moveable against the bias toward a second end of the at least one slot as the moveable contact and the stationary contact are moved into and out of contact with each other.

6. The circuit interrupter of claim 4 wherein the biasing member is a spring positioned between the contact arm carriage and the contact arm member.

7. The circuit interrupter of claim 6, wherein the spring is a leaf spring.

8. The circuit interrupter of claim 1, further comprising a resetting mechanism adapted to reset the circuit interrupter and move the moveable contact into physical contact with the stationary contact by movement of the moveable contact arm assembly, the resetting mechanism being connected to the linkage assembly via at least two pivots positioned on the resetting mechanism.

9. The circuit interrupter of claim 8, wherein the resetting mechanism comprises a handle having a portion thereof extending from the housing adapted to be actuated by a user.

10. The circuit interrupter of claim 8, wherein the resetting mechanism comprises a push button mechanism having a portion thereof extending from the housing adapted to be actuated by a user.

11. A circuit interrupter having a housing within which components of the circuit interrupter are disposed, the circuit interrupter comprising:

a line terminal connectable to a source of electrical power;

a load terminal connectable to a load;

a stationary contact positioned within said housing;

a moveable contact arm assembly having a moveable contact positioned thereon, the moveable contact configured to be moveable into and out of physical contact with the stationary contact by movement of the moveable contact arm assembly so as to place the line terminal and the load terminal into and out of electrical communication, the moveable contact arm assembly comprising a contact arm carriage and a contact arm member, the contact arm member slideable within the contact arm carriage, and wherein the at least two pivots positioned on the contact arm assembly are positioned on the contact arm carriage;

an overcurrent tripping device coupled to the moveable contact arm assembly via a linkage assembly and configured to move the moveable contact out of physical contact with the stationary contact upon detection of an overcurrent situation;

wherein the moveable contact arm assembly is connected to the linkage assembly via at least two pivots positioned on the contact arm assembly, so as to cause a relative sliding action between the moveable contact and the stationary contact as the moveable contact and the stationary contact are moved into or out of contact with each other such that a wiping action is created in order to clean the moveable and stationary contacts; and a resetting mechanism adapted to reset the circuit interrupter and move the moveable contact into physical contact with the stationary contact by movement of the moveable contact arm assembly, the resetting mechanism being connected to the linkage assembly via at least two pivots positioned on the resetting mechanism.

12. The circuit interrupter of claim 11, wherein the contact arm carriage has at least one slot formed therein, and wherein the contact arm member comprises at least one pin projecting from a surface thereof, the at least one pin cooperating with and slideable within the at least one slot.

13. The circuit interrupter of claim 12, wherein the at least one pin slides within the at least one slot as the moveable contact and the stationary contact are moved into and out of contact with each other.

14. The circuit interrupter of claim 12, further comprising a biasing member cooperating with the contact arm carriage and the contact arm member, the biasing member biasing the contact arm carriage and the contact arm member with respect to each other such that the at least one pin is biased toward a first end of the at least one slot.

15. The circuit interrupter of claim 14, wherein the at least one pin is moveable against the bias toward a second end of the at least one slot as the moveable contact and the stationary contact are moved into and out of contact with each other.

16. The circuit interrupter of claim 14 wherein the biasing member is a spring positioned between the contact arm carriage and the contact arm member.

17. The circuit interrupter of claim 16, wherein the spring is a leaf spring.

18. The circuit interrupter of claim 11, wherein the resetting mechanism comprises a handle having a portion thereof extending from the housing adapted to be actuated by a user.

19. The circuit interrupter of claim 11, wherein the resetting mechanism comprises a push button mechanism having a portion thereof extending from the housing adapted to be actuated by a user.

* * * * *